US005295463A

United States Patent [19]

Wenger et al.

[11] Patent Number: 5,295,463

[45] Date of Patent: Mar. 22, 1994

[54] INTERNAL COMBUSTION ENGINE WITH OIL PUMP MOUNTED ON THE CAMSHAFT

[75] Inventors: Urs Wenger; Hans R. Jenni, both of Langenthal; Hans P. Goetti, Zetzwil, all of Switzerland

[73] Assignee: SMH Management Services AG, Biel, Switzerland

[21] Appl. No.: 973,817

[22] Filed: Nov. 6, 1992

[30] Foreign Application Priority Data

Nov. 6, 1991 [FR] France ..... 91 13769

[51] Int. Cl.[5] ..... F01M 1/00

[52] U.S. Cl. ..... 123/196 R; 184/6.28

[58] Field of Search ..... 123/196 R, 198 C; 184/6.28

[56] References Cited

U.S. PATENT DOCUMENTS 3,087,582 4/1963 Potter ..... 184/6
4,436,067 3/1984 Fritzenwenger ..... 123/198 C
4,565,168 1/1986 Rivere ..... 123/196 R
4,573,439 3/1986 Kasting ..... 123/198 C

FOREIGN PATENT DOCUMENTS 0271384 6/1988 European Pat. Off. .
1365805 9/1974 United Kingdom .

*Primary Examiner*—Noah P. Kamen
*Attorney, Agent, or Firm*—Weil, Gotshal & Manges

[57] ABSTRACT

The invention discloses an internal combustion engine in which the open housing oil pressure pump (1) is closed by securing it directly onto the cylinder head (5), the moving elements of the pump being fixed to the camshaft (20) by means of an axial abutment (29). Sealing is assured on the one hand by means of an O ring (25) between the pump (1) and the head (5), on the other hand by means of a lip seal (45) and a breather (51). The axial play (44), also affecting the sealing, is maintained at the desired amount by means of the levelled washer (47). The application is to all engines for which reduction in weight, volume and maintenance cost is sought.

10 Claims, 4 Drawing Sheets

INTERNAL COMBUSTION ENGINE WITH OIL PUMP MOUNTED ON THE CAMSHAFT

The present invention has as its objective an internal combustion engine in which the special arrangement of the pressure pump for circulating oil in the different elements enables diminishing the volume and weight of said engine, as well as its maintenance cost, for example during disassembly operations.

BACKGROUND OF THE INVENTION

In the usual engines, the pressure pump serving to circulate oil in the different elements to be lubricated is constituted by an independent mechanical assembly with a closed casing, driven either directly by the crankshaft or indirectly by the latter by appropriate means such as gearing or a synchronous belt.

SUMMARY OF THE INVENTION

The engine according to the invention has on the contrary a pressure pump for oil circulation with an open casing closed by directly securing it onto the cylinder head, the moving elements of the pump being directly driven by the camshaft to which they are fixed by means of an axial abutment. In accordance with the invention, sealing between the cylinder head and the body of the pump is assured by O-rings and lip seals and the axial play is adjusted by means of a levelled washer arranged between an annular shoulder of the pump body and the corresponding internal face of the moving element of the pump driven by the camshaft.

In order better to understand the invention and bring out more clearly other characteristic purposes, details and advantages, the detailed description following concerns an embodiment of an engine equipped with a gear pump.

DESCRIPTION OF THE PREFERRED EMBODIMENT

Figure 1:
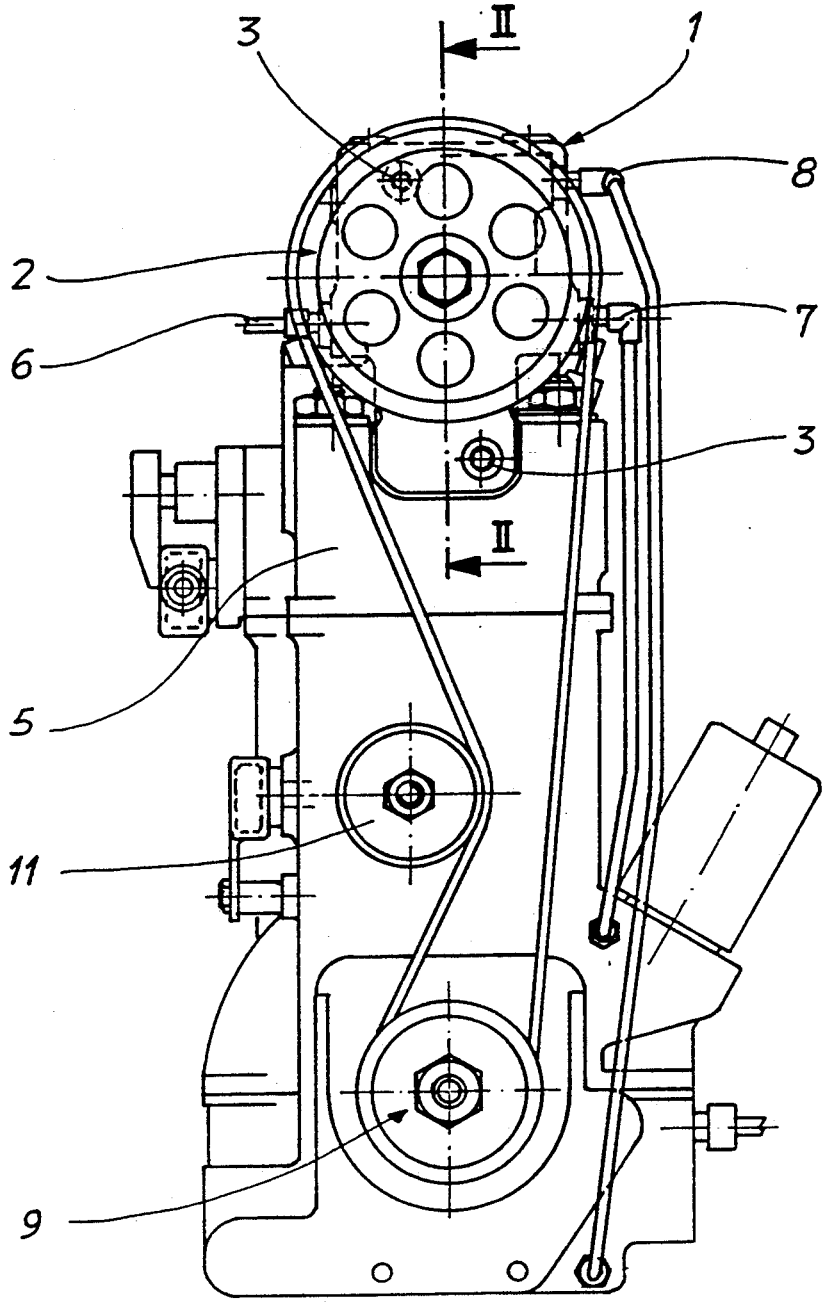
FIG. 1 is a face view of the complete engine with the pressure pump.

In FIG. 1, it is seen that pump 1, partially masked by the driving fly wheel 2 of the camshaft, is secured by screws 3 onto the cylinder head 5 of the engine. On this figure are also shown the inlet pipes 6 and outlet pipes 7 of the oil for the pump as well as the inlet pipe 8 for oil in the element 22 for distributing oil on the camshaft bearings. Pulley 11 is solely present to form a tensioning means for the belt coming from pulley 9 secured onto the crankshaft.

Figure 2:
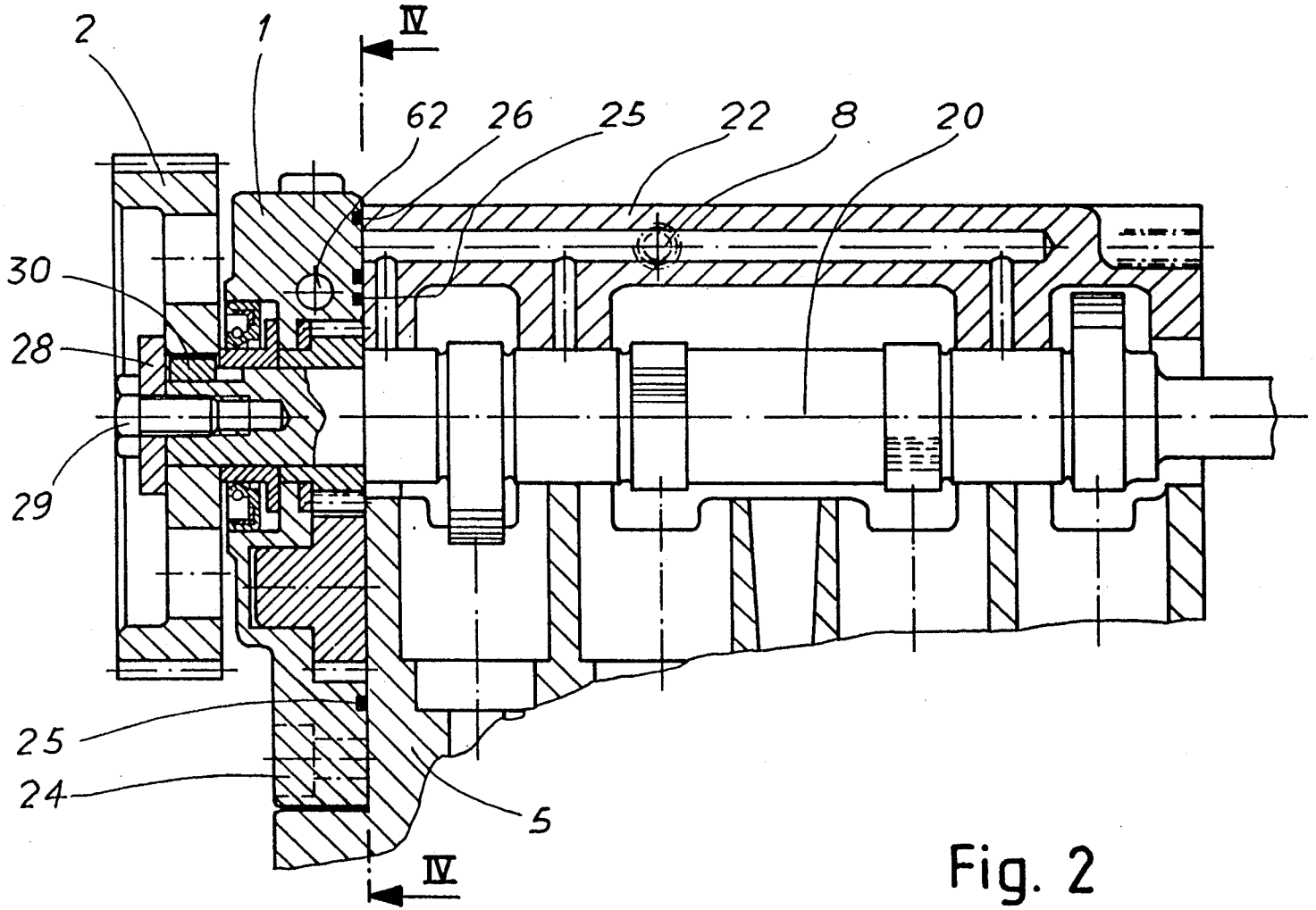
FIG. 2 is an enlarged partial cross-section along line II—II of FIG. 1 showing the camshaft and the oil distribution circuit for the bearings.

FIG. 2, which is an enlarged view of the crosssection along line II—II of FIG. 1, shows the assembly of the camshaft situated in cylinder head 5 with, on the one hand, element 22 for distributing oil on the bearings and on the other hand pump 1 and the driving fly wheel 2. In the body of pump 1 appears in broken outline one of the fastening screws 24 of the pump body onto the cylinder head. The O-ring seal 25 assures sealing between the body of the pump and the cylinder head and the seal 26 between the pump body and the open end of the camshaft bearing oil distribution element 22 acts similarly. Washer 28 and screw 29 constitute the camshaft abutment, the latter being fixed to rotate with the driving fly wheel 2 by key 30.

Figure 3:
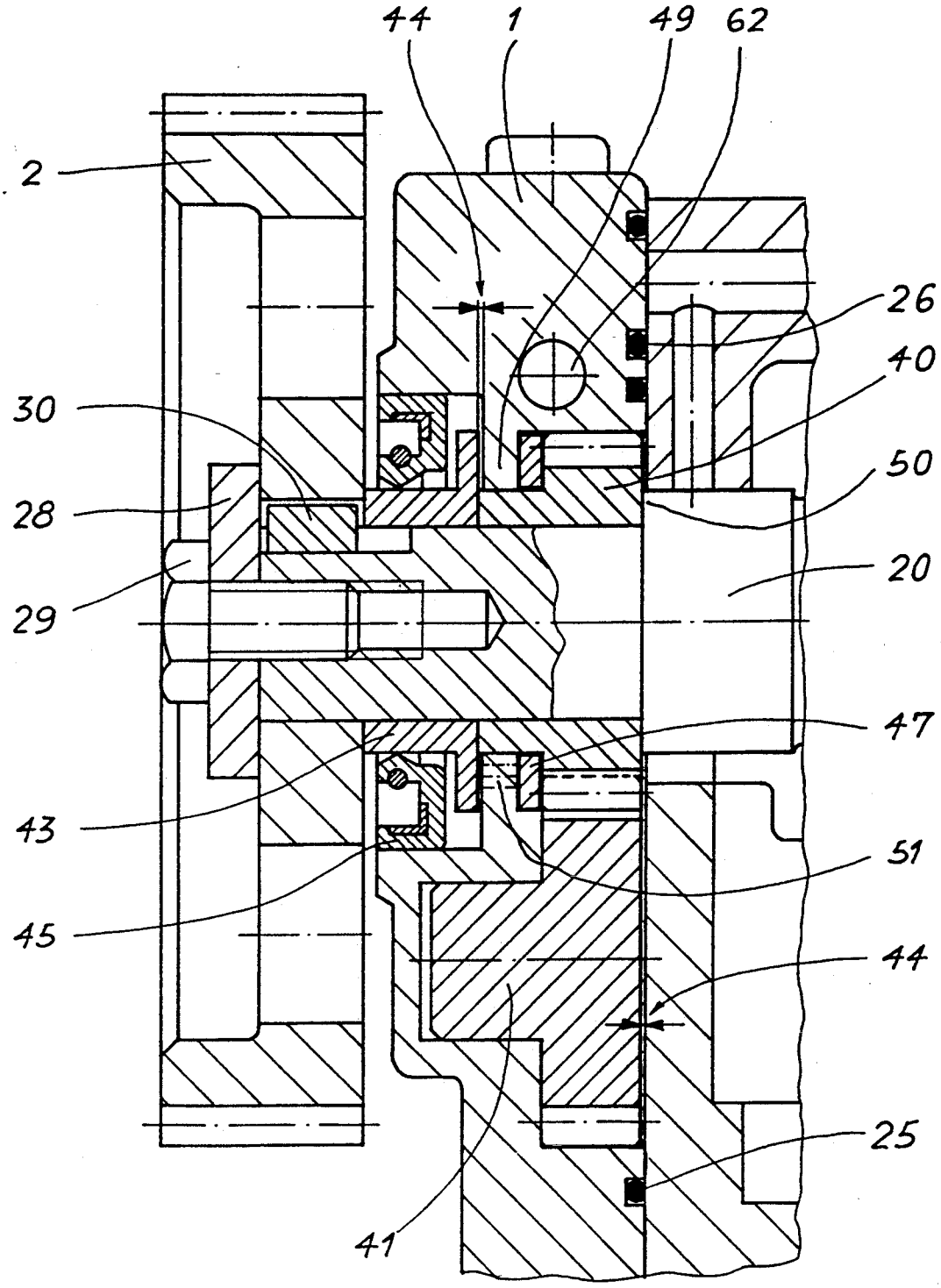
FIG. 3 is an enlarged view of FIG. 2 limited to the portion concerning the pump.

FIG. 3, which is an enlargement of a portion of FIG. 2, enables better understanding of putting the invention into effect at the level of the pump itself. Reference 40 designates the driving pinion of the gear pump and reference 41 designates the loose pinion. Part 43 is a ring with a collar engaged on camshaft 20 between fly wheel 2 and pinion 40, the lip seal 45 bearing on said collared ring. Pinion 40 itself bears on the annular shoulder 50 of the camshaft. The levelled washer 47 is positioned between the internal face of the driving pinion 40 and a shoulder 49 of the pump block. In this shoulder also appears in broken outline a breather 51 connecting the space in which the seal 45 is situated and the suction side of the pump.

Figure 4:
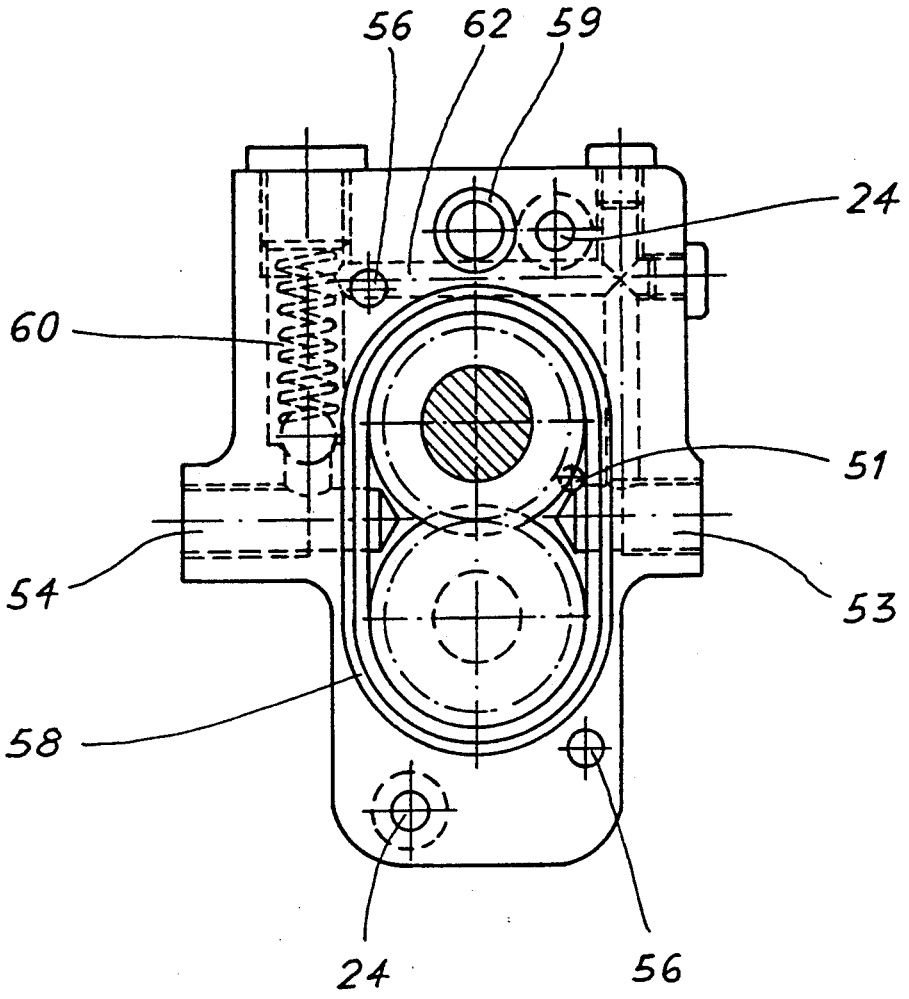
FIG. 4 is a side view of the pump, separated from the cylinder head, according to arrow IV of FIG. 4.

In addition to the elements already described in the preceding figures, FIG. 4 shows the oil inlet orifice 53 and outlet orifice 54; holes 56 are intended for guide pins and holes 24 for assembly screws 3; grooves 58 and 59 are intended to receive seals between the body of pump 1 and on the one hand the cylinder head 5, on the other hand the camshaft bearings oil distribution element 22. Reference 60 designates the safety valve assembly. The return pipe 62 from the safety valve appears also in cross-section on FIGS. 2 and 3.

In order to assure, at the same time sufficient sealing and the necessary axial play to avoid seizing up, for the gear pump of the engine, according to the invention, when it is in operation, it has been necessary to conceive a special assembly of the parts which will be of no use in closed casing pumps forming an independent mechanical assembly.

Sealing between the body of the pump and the cylinder head is assured by the O-ring 25 housed in groove 58 and maintained under pressure by means of screws 3. It is thus apparent, once the driving fly wheel has been removed, that simple unscrewing of screws 3 enables one, at the same time, to remove and to disassemble the pump for its maintenance. The O-ring seal 26 housed in groove 59 enables hermetically closing the pipe orifice of the oil distribution element 22, said orifice resulting from the requirements of the machining operations.

Sealing in the sense of the camshaft on the side of the driving fly wheel is assured on the one hand by lip seal 45 force mounted to bear on ring 43, on the other hand by the levelled disc 47 which permits very precise adjustment to the necessay minimum of play 44 which must exist between the parts in rotation and the body of the pump or the cylinder head. In order to avoid an accumulation of oil in the space located between the lip seal, the body of the pump and the ring with collar 43, it is furthermore provided to suck out said oil by means of a breather 51 connecting said space and the oil input zone in the pump.

In order to understand the essential role of the levelled disc 47, it is useful to recall that mass production of the cylinder head does not enable assuring a sufficient precision in order that the annular shoulder 50 of the camshaft, on which are blocked drive pinion 40 and ring 43 by means of screw 29, allow maintenance of an axial play 44, on the one hand between pinions 40–41 and the portion of the cylinder head onto which the pump is secured, on the other hand between ring 43 and the annular shoulder 49 of the pump body. In the absence of the levelled disc 47, that is to say if the annular shoulder had additional thickness corresponding to the thickness of disc 47, recovery of the play due to wear of the annular shoulder 49 by friction of pinion 40, could not be effected except by truing the entire surface of the pump in contact with the cylinder head and the annular cross-section of pinion 40 in contact with the collar of ring 43.

According to the invention, it is on the other hand very easy, either on the occasion of periodic maintenance services, or if an oil leak is determined, to proceed to dismantling the pump and to replacement of the worn levelled disc by a new levelled disc. It is thus possible to maintain in permanence and very simply a constant axial play 44 at the desired value, for example a play of 50 μm.

Thanks to this conception and the particular arrangement of the pump, it is thus possible to obtain engines of all types according to the invention showing a reduced volume and weight and for which maintenance of the oil pressure pump is greatly facilitated.

What we claim is:

1. An internal combustion engine having a camshaft, a cylinder head and an oil circulation circuit which circuit includes a pressure pump for circulating oil in the engine, said pump having an open housing said housing and said cylinder head having mating surface for mounting said pump on said cylinder head thereby closing said housing, said pump including a moving element and an axial abutment for fixing said moving element to said camshaft for being directly driven thereby.

2. An internal combustion engine as set forth in claim 1 further including a O-ring seal for sealing between said mating surfaces.

3. An internal combustion engine as set forth in claim 1 further including a lip seal and a breather for sealing between the pump and the camshaft on the outer side of the pump.

4. An internal combustion engine as set forth in claim 3 wherein the breather is coupled to the suction side of the pump.

5. An internal combustion engine as set forth in claim 1 wherein said pump includes a plurality of moving elements including gearing having a drive pinion and a loose pinion.

6. An internal combustion engine as set forth in claim 5 wherein said axial abutment includes a washer and screw and further including a flywheel affixed said camshaft by said washer and screw, said pump further including a ring mounted for rotation with said camshaft, wherein said camshaft has an annular shoulder, the drive pinion being held to bear on said annular shoulder by said ring which itself bears against said flywheel for assuring clamping of the assembly of parts of the pump.

7. An internal combustion engine as set forth in claim 5 further including a levelled washer for adjusting the axial play of said pump.

8. An internal combustion engine as set forth in claim 7 wherein the levelled washer is interposed between an annular shoulder of said housing and a corresponding face of the drive pinion.

9. An internal combustion engine as set forth in claim 1 further including a levelled washer for adjusting the axial play of said pump.

10. An internal combustion engine as set forth in claim 9 wherein the levelled washer is interposed between an annular shoulder of said housing and a corresponding face of said moving element.

* * * * *